US005095745A

United States Patent [19]

Desbrandes

[11] Patent Number: 5,095,745

[45] Date of Patent: Mar. 17, 1992

[54] METHOD AND APPARATUS FOR TESTING SUBSURFACE FORMATIONS

[75] Inventor: Robert Desbrandes, Baton Rouge, La.

[73] Assignees: Louisiana State University; Agricultural and Mechanical College, both of Baton Rouge, La.

[21] Appl. No.: 538,825

[22] Filed: Jun. 15, 1990

[51] Int. Cl.[5] ..... E21B 49/08

[52] U.S. Cl. ..... 73/152; 73/153; 166/264

[58] Field of Search ..... 73/38, 152, 153; 166/264, 64, 250

[56] References Cited

U.S. PATENT DOCUMENTS 4,597,439 7/1986 Meek ..... 166/264
4,903,765 2/1990 Zunkel ..... 166/64

FOREIGN PATENT DOCUMENTS 1352764 1/1964 France ..... 166/264
274044 9/1970 U.S.S.R. ..... 166/264
1332011 8/1987 U.S.S.R. ..... 166/264

*Primary Examiner*—Hezron E. Williams
*Assistant Examiner*—Craig Miller
*Attorney, Agent, or Firm*—William D. Kiesel; Robert C. Tucker

[57] ABSTRACT

A method and apparatus for testing subsurface formations, particularly a formation having a permeability less than about 10 millidarcies is disclosed. The test is made by use of a down hole test tool designed in such a way as to control the decompression of the fluid as it enters the tool. The formation characteristics are determined by analyzing the pressure versus time plot resulting from the test. Such characteristics as flow rate of liquid phase mud through the mud cake, formation permeability, formation pressure, invasion diameter, and the extent of supercharging, can be determined. The entire test takes no longer than a few minutes, versus hours and sometimes days for more conventional techniques and test tools.

24 Claims, 8 Drawing Sheets

METHOD AND APPARATUS FOR TESTING SUBSURFACE FORMATIONS

FIELD OF THE INVENTION

This invention relates to a method and apparatus for determining characteristics of earth formations, particularly those having a permeability of less than about 10 millidarcies. Such characteristics include the flow rate of liquid phase drilling fluid through the mud cake, the formation pressure, permeability of the formation, invasion diameter, and the extent of supercharging. Formation measurements are made with the use of a novel drill stem tool designed to controllably decompress the drilling mud in the bore hole. The measurements are completed in a matter of a few minutes as opposed to hours, or even days, as required by more conventional techniques.

BACKGROUND OF THE INVENTION

Because of the significant expense involved with drilling oil and gas wells, it is desirable to determine such characteristics as the pressure, permeability, and invasion diameter of a subsurface formation in order to determine the ability of the well to produce before committing further resources. For example, formation pressure data is important for evaluating the extent of the reserves and the permeability of the formation is important because it is needed to develop an economical production plan. Much work has been done over the years in developing techniques and down hole tools to make these determinations. In one conventional method for determining the characteristics of subsurface formations, the well is cased down to the producing formation, or even through the formation, and perforated to allow fluid entry. Ordinarily, the well stands full of drilling fluid, or water, to control the escape of valuable fluids from the producing formation. A string of tubing is lowered into this well, the tubing having a valve at its base. This valve is ultimately located essentially at the top of the producing formation. A second valve is located at the top of the drill string which leads to a surface pressure measuring device, often a deadweight tester. There can also be a bottom hole pressure measuring device, called a pressure bomb, which can be either internal plotting, or surface recording.

Testing was generally divided into three parts for cased formations. The first part involved measurement of the initial formation pressure by using a pressure bomb to determine bottom hole pressure before formation fluid is drawn. This was followed by a three day flow test to allow formation fluid to flow to the surface for rate determination at a constant rate. The final portion of the test was a six-day pressure build-up test in which the well was shut-in and the bottom hole pressure recorded versus time, so that the formation flow capacity and skin effect could be determined.

It was found that it was necessary to shut the wells in at the bottom of the tubing string for low to moderate permeability gas wells. This was generally done using some type of controllable tubing valve, and preferably employing a packer on the outside of the tubing to close the annulus at the top of the production formation. This second procedure was preferred instead of shutting in the well at the top. Shutting-in the well at the top takes much longer in low permeability formations to reduce the flow of fluid into the well to a low enough value to allow for analysis of the build-up pressure curve. While such a method was somewhat satisfactory, it suffered from the disadvantages that: (1) the measurement of fluid flow rates were notoriously poor for low permeability formations; and (2) the total testing time was too long, for example, on the order of about 6 to 10 days, or more.

In situations where the bore hole is open (not cased), especially when the formation is relatively soft, the above procedure is not practiced because of time restraints. That is, in open wells, because the testing time often exceeds an hour, there is fear that the walls of the bore hole will cave-in and trap the drill string. Thus, there would be a great advantage if the measurements needed to determine the characteristics of a formation could be performed in only a matter of minutes. The present invention provides such an advantage.

An improvement to the above technique for cased-in wells is disclosed in U.S. Pat. No. 4,423,625, which teaches a so-called "limited volume well bore transient test". Formation fluid flows into a volume of known dimensions in a down hole test tool and the rate of pressure increase is measured with time. Such a method supposedly permits calculation of flow rates from knowledge of the properties of the fluid, the temperature of the gas, and the volume into which it is flowing. Although the method disclosed in this '625 patent did substantially decrease the test time, it still took from about 12 to 24 hours to complete the test, which is much too long for successfully testing a formation in an open well.

Consequently, there exists a great need in the art for a method and apparatus which will reduce the time needed for making formation measurements for determining such characteristics as formation pressure, permeability, and invasion diameter of subsurface formations, especially in low permeability formations from open wells.

SUMMARY OF THE INVENTION

In accordance With the present invention, there is provided a method and a drill stem down hole test tool, for testing subsurface formations from a bore hole containing compressed drilling fluid. The method comprises:

(a) positioning a drill stem down hole test tool down a bore hole adjacent to the formation to be tested, said test tool containing: (i) an entry port, (ii) a chamber of known volume, (iii) a means for controlling the flow rate of the drilling fluid into the test tool, and (iv) a pressure measuring means;

(b) utilizing at least one packer to isolate an interval of bore hole by expanding the packer and sealing the annular space between the test tool and the bore hole;

(c) effectively controlling the flow rate of drilling fluid into the chamber of the test tool so that substantial instantaneous decompression of the drilling fluid does not occur; and (d) measuring and plotting the pressure as a function of time from the time the seal is made between the test tool and the wall of the bore hole until at least the time at which the chamber of the test tool is filled with drilling fluid.

In a preferred embodiment of the present invention, the method is preformed on a formation having a permeability from about 0.05 to about 5 millidarcies.

In another preferred embodiment of the present invention, the drilling fluid is mud and the flow rate of mud entering the test tool is in the range from about 0.4 $in^3$/min to about 40 $in^3$/min for a volume of mud of about 13,000 $in^3$ (which corresponds to 8½" diameter bore hole 20 feet long).

In yet other preferred embodiments of the present invention, the pressure versus time plot resulting from practice of the present invention is used to determine one or more of: (a) the flow rate of liquid phase mud passing through the mud cake; (b) the permeability of the formation; (c) the formation pressure; (d) the invasion diameter; and (e) the extent of supercharging.

In still another embodiment of the present invention, the testing is conducted with a drill stem test tool comprising:

(a) an elongated housing;
(b) at least one packer for isolating an interval of bore hole when inflated;
(c) at least one entry port for receiving drilling fluid into the test tool;
(d) at least one chamber of know volume;
(e) a means for effectively controlling the flow rate of drilling fluid into the test tool;
(f) a pressure sensing means in communication with a recording means.

In a preferred embodiment concerning the test tool, the tool contains a means for unseating the packer, expelling the drilling fluid, and reseating the packer, and running another test, in the same or at a different location in the bore hole, without having to be raised to the surface.

DETAILED DESCRIPTION OF THE INVENTION

While the present invention can be practiced in subsurface formations having any degree of permeability, it is preferred to practice this invention in formations of relatively low permeability. The term low permeability, as used herein, means formations having a permeability less than about 10 millidarcies (md), preferably from about 0.05 to about 5 md, more preferably from about 0.1 to 1 md. Permeability, which is a measure of the resistance to flow through a porous medium under the influence of a pressure gradient, is measured in darcies in petroleum production technology. A porous structure has a permeability of 1 darcy if, for a fluid of 1 centipoise [$10^{-3}$ (Pa)(s)]viscosity, the volume flow is 1 $cm^3/(s)(cm^2)$ under a pressure gradient of 1 atm/cm. Thus, a formation having a permeability less than about 1 md is an exceptionally tight, or low permeability formation.

Figure 1:
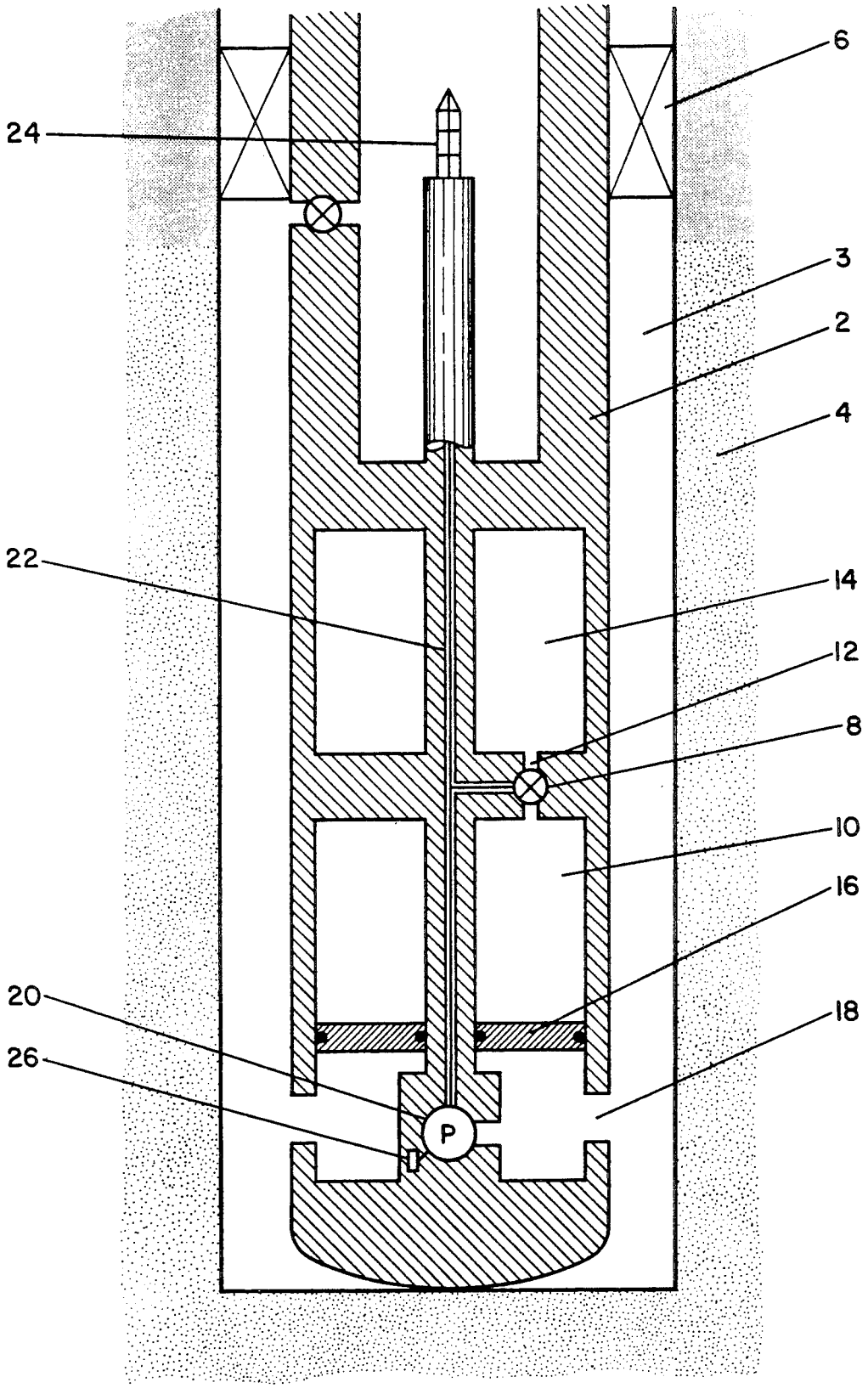
FIG. 1 hereof is a schematic of a down hole test tool which incorporates the principles of the present invention, and which operates in a single-test mode. That is, the tool would have to be raised to the surface after each test. It is to be understood that the apparatus of the present invention is by no means limited to the actual features of this Figure, or to FIGS. 2 and 3 hereof.

FIG. 1 hereof is a schematic of a preferred down hole test tool 2, of the present invention for single-shot testing. That is, a tool capable of taking only one test of the formation before being raised to the surface. The tool is shown down a bore hole filled with a weighted pressure control fluid 3, commonly called a drilling fluid, which is typically drilling mud, and which will hereinafter be referred to as mud. The tool is positioned in the bore hole adjacent to the formation 4 to be tested. In practice, the tool of this invention will be run on drill pipe, or tubing, and can be one of many tools on a drill string.

Sealing means 6, which is typically a packer, is used to seal the annular space between the drill string and the wall of the bore hole, thus isolating an interval of bore hole for testing. In FIG. 1 hereof, the bore hole interval is defined by the packer at the top and by the floor of the bore hole at the bottom. It will be understood that the bore hole interval can also be defined by a pair of packers, which is sometimes referred to as a straddle-packer system. Straddle-packers are used to isolated the formation to be tested from the rest of the bore hole. In any event, any appropriate sealing means is suitable for use herein. The packer may be inflated by any appropriate means, including use of a hydraulic fluid or even by a mechanical means, which may be activated by contacting the nose of the drill string against the floor of the bore hole. It is understood that the actual employment of the packer(s) will depend on the formation to be tested and its location in the bore hole. That is, the formation to be tested must be isolated from any other formation in order to make accurate measurements for that particular formation.

When the seal(s) between the tool and the bore hole is made, and before valve 8 is opened to allow mud to enter the lower chamber 10, some of the liquid phase of the mud (filtrate) passes through the mud cake and invades the formation. This occurs in open bore holes because, at this stage, the mud pressure is greater than the formation pressure. The mud cake is formed during drilling which is usually conducted in "overbalance" conditions. That is, the hydrostatic pressure of the mud is designed to be greater than the formation pressure in order to prevent formation fluid from entering the bore hole and causing a blowout. The solid particles of the mud form a low permeability cake on the bore hole wall, through which the liquid phase of the mud passes and invades the porous zones of the formation. The thickness and the texture of the mud cake, and 10 the size of the invaded zone, also referred to as the invasion diameter, are important considerations during drilling, as well as in well logging operations.

Figure 4:
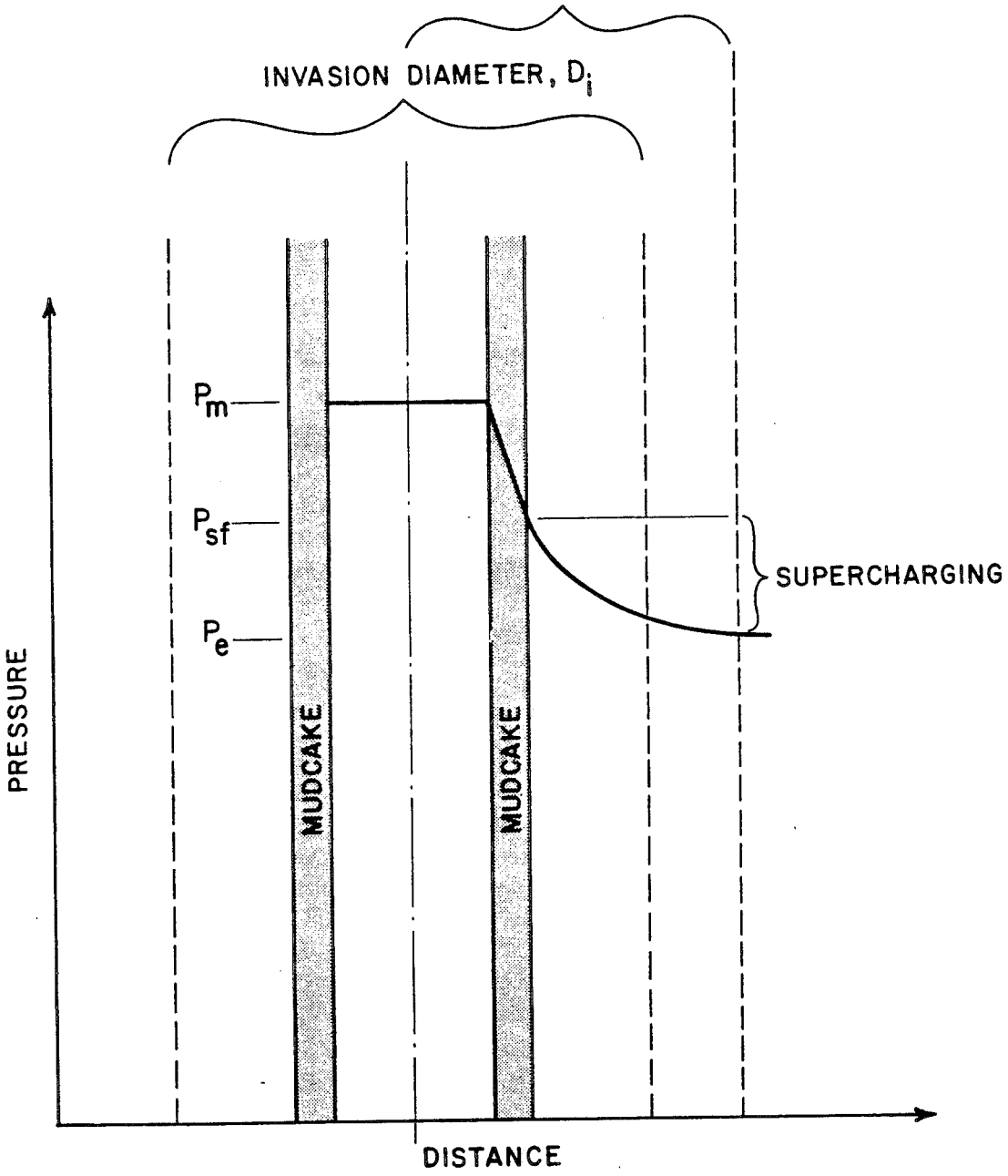
FIG. 4 hereof is a graphical representation of a pressure versus distance profile of a typical bore hole in which the present invention can be practiced. It shows, inter alia, the bore hole, the mud cake, and the formation. Phenomena such as supercharging and invasion diameter are also shown in this figure.

FIG. 4 hereof is a pressure versus distance profile of a bore hole filled with mud in a low permeability formation. The hydrostatic pressure of the mud is represented by pressure $P_m$. As liquid phase mud passes through the mud cake a pressure drop occurs. This is shown between the hydrostatic pressure $P_m$ and the sand face pressure $P_{sf}$. The sand face, of course, is the face of the formation to which the mud cake is adhered. Liquid phase mud will continue to be pushed into, or invade, the formation until it is at the same pressure as the formation pressure $P_e$. The distance to which this liquid phase mud invades the formation is referred to as the invasion diameter, which is represented by $D_i$ of FIG. 4 hereof. Furthermore, the difference between the sand face pressure $P_{sf}$ and the formation pressure $P_e$ is the extent of supercharging. Supercharging is caused by a pressure loss due to the flow of filtrate into the low permeability formation. It is important to know the extent of supercharging in order to correct for it in determining the formation pressure. For relatively high permeability formations, the extent of supercharging is negligible because the difference between the formation pressure and the pressure at the sand face is negligible. The radius of pressure perturbation is represented by $r_e$ in FIG. 4 hereof. This is a well known phenomena and refers to the distance at which the pressure change from the formation pressure can be measured to 1% of the difference between the sand face pressure and the formation pressure. Phenomena such as the pressure drop of liquid phase mud passing through the mud cake, invasion diameter, and supercharging are known. Typically, they can only be measured under laboratory type settings for simulated bore holes and not in such a large section of the formation at down hole conditions, as can be achieved by the practice of the present invention.

Returning now to FIG. 1 hereof, when the seal(s) between the tool and the bore hole is made, valve 8 is opened to allow passage of the hydraulic fluid contained in lower chamber 10 to pass through choke 12 into upper chamber 14 by an upward pressure exerted on floating piston 16. The upward pressure is delivered by the mud as it enters the tool, in a compressed state, through port 18. It is only by carefully controlling the decompression of the mud trapped in the isolated bore hole interval that one is able to make the appropriate formation measurements in a matter of minutes, instead of hours or days. For example, the flow rate of the mud into the tool is effectively controlled, thus slowly increasing the volume of the mud. The term "effectively controlled" as used herein, means that the flow rate of the mud into the tool is controlled so that substantial instantaneous decompression does not occur. The flow rate will generally be kept between about 0.4 $in^3$/min to about 40 $in^3$/min, preferably from about 0.8 $in^3$/min to about 8 $in^3$/min, for a mud volume of about 13,000 $in^3$ (which corresponds to an 8½" diameter bore hole 20 feet long). Of course, the flow rates will be different depending on the volume of mud, but such calculation are easily performed by those having ordinary skill in the art. This corresponds to a decompression rate of about 10 psi/min to 1000 psi/min, preferably from about 20 psi/min to 200 psi/min. The increase of volume results in a corresponding decrease in pressure. That is, the volume increase of mud due to sampling at a flow rate, dV/dt, induces a change of pressure according to the expression:

$$dp/dt = [1/CV]dV/dt \quad (1)$$

where,

C is the compressibility of the mud;

V is the volume of mud in the isolated bore hole interval;

dp/dt is the pressure change with time.

This expression assumes that the effect of dV on V is negligible, because only a few cubic inches of mud are affected out of over 13,000 cubic inches. The exact formula which compensates for this affect can be easily derived by one having ordinary skill in the art and thus, its derivation is not deemed to be necessary for purposes of this discussion.

Therefore, ideally, if dV/dt is constant(constant flow rate), dp/dt is also constant, and the pressure decreases substantially linearly with time as long as no fluid is released from the formation. This occurs when the mud pressure is less than the sand face pressure, indicating the sand face pressure.

As the volume of the mud expands into the lower chamber, it moves the piston 16 upward and forces the hydraulic liquid from the lower chamber into the upper chamber through choke 12. The size of the opening of this choke is critical to the present invention in that it must be able to effectively control the flow of drilling fluid into the tool so that substantial instantaneous decompression does not occur. The opening of the coke is chosen to give a predetermined flow rate for a given volume of mud at a given compressibility. Selection of a suitable choke opening is within the skill of those in the art given the teaching of the present invention. A chart of flow rate as a function of pressure for different chokes can be found on page 361 of Encyclopedia of Well Logging, Graham & Trotman Limited*****, 19, by Robert Desbrandes, the inventor of the present invention. The dimensions of the choke may be fixed at a predetermined opening, or the opening may be adjusted from the surface by any appropriate means. For example, the opening of the choke may be controlled by a so-called variable choke device, or it can be servo controlled. An example of a variable choke which may be used in the practice of the present invention can be found in the disclosure of U.S. Pat. No. 2,872,230, to R. Desbrandes, which is incorporated herein by reference.

If the decompression of the mud is not controlled, then virtually instantaneous decompression of the mud occurs, driving the pressure in the bore hole far below the formation pressure. For low permeability formations, the build-up of pressure from this very low pressure to the formation pressure can take hours, or even days. This time frame is generally unacceptable for open wells because of the danger of the wall caving-in on the test tool before the test can be completed. With practice of the present invention, low permeability formations can be measured in a matter of minutes, thereby minimizing the risk.

The means for measuring pressure can be any appropriate means commonly used to measure down hole pressure. For example, it may be a down hole pressure measuring device, called a pressure bomb, which can be powered by battery and in which the pressure is automatically recorded as a function of time. It may also be a device such as the Hewlett-Packard telemetering type bomb in which case signals are sent to the surface over a circuit (not shown) in the ordinary way of using this device. For purposes of FIG. 1 hereof, the pressure is measured by sensing device 20 which is in electrical communication through wire 22 which leads to wet connector 24, which will plug into a complementary receiving connector (not shown), which will be part of another tool (not shown) in the drill string. The electrical connection will eventually lead to a recording means (not shown) at the surface level.

The pressure versus time recording of the present invention may be made by any appropriate means. Such means include conventional surface recording and monitoring equipment, as well as down hole recording means. For example, a down hole recording may be initiated by a triggering mechanism which is triggered during the seating of the packer by a mechanism such as a strain gauge switch 26. A strain gauge is a resistor, which resistance varies with the strain applied to the metallic substrate to which it is bonded. The resistance variation activates an electronic circuit. In fact, the switching mechanism for the down hole recording device may be used to operate the entire cycle of the tool. That is, it can start the recording at a predetermined time, seat and unseat the packer, as well as expelling fluid from the tool in the case of a multi-test tool. Such mechanisms are also well know in the art.

Figure 6:
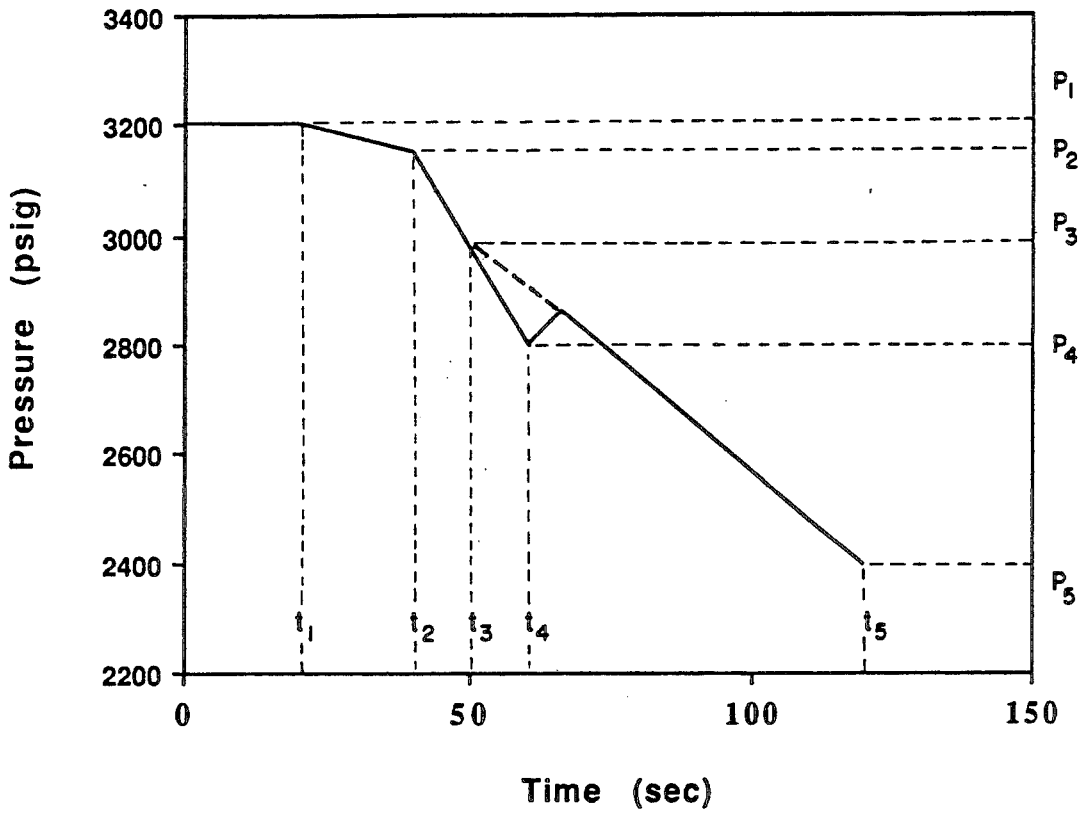
FIG. 6 hereof is a representation of a typical pressure versus time curve which will result from practice of the present invention in the same low permeability formation as that for FIG. 5 hereof.

FIG. 6 hereof is a typical recording of pressure versus time which will result from a formation test run in accordance with the present invention for a low permeability formation. Pressure $P_1$ represents the hydrostatic pressure of the mud. Time $t_1$ is the time at which the packer(s) is set and time $t_2$ is the time at which the valve is opened to let fluid controllably enter the test tool. The time between $t_1$ and $t_2$ represents a stage in the test where only seepage of liquid mud through the mud cake and toward the formation is occurring. That is, no draw down of formation fluid to the bore hole is taking place. Because only seepage is taking place, the volume of mud has not increased significantly, and thus only, a small change in pressure is observed, that is $P_1-P_2$. Pressure $P_2$ is the reduction of pressure due to seepage of liquid phase mud through the mud cake. There is a pressure drop because after the packer(s) is set, the isolated volume of mud expands due to this seepage, resulting in a corresponding drop of pressure. Pressure $P_3$ represents the sand face pressure. Between times $t_2$ and $t_3$, the flow rate is equal to the rate of draw down plus the rate of seepage of liquid phase mud. Thus a greater change in pressure takes place. During this phase, draw down is substantially constant and the rate of seepage is decreasing. Time $t_5$ is the time at which the test is stopped.

The generation of such a unique and detailed pressure versus time curve by the practice of the present invention enables one having ordinary skill in the art to determine various important characteristics of the formation. For example, the slope of the pressure curve between time $t_1$ and time $t_2$, which represents the seepage of the liquid phase of the mud into the formation, can be used to calculate the flow rate of this liquid phase mud into the formation. This flow rate is calculated by solving for dV/dt in previously discussed equation (1). The flow rate during decompression of the mud between $t_2$ and $t_3$ can also be calculated by solving for dV/dt in equation (1).

The dip in the curve at $P_4$ is due to the pressure increase which builds and finally causes the mud cake to break away from the wall of the formation. This pressure increase is typically in the range of about 10 to 200 psi. After the mud cake breaks away, the pressure then recovers to the draw down pressure and rate of decline. The sand face pressure $P_3$ can then be determined by extrapolating from $P_5$ to $P_3$ on the curve.

Figure 7:
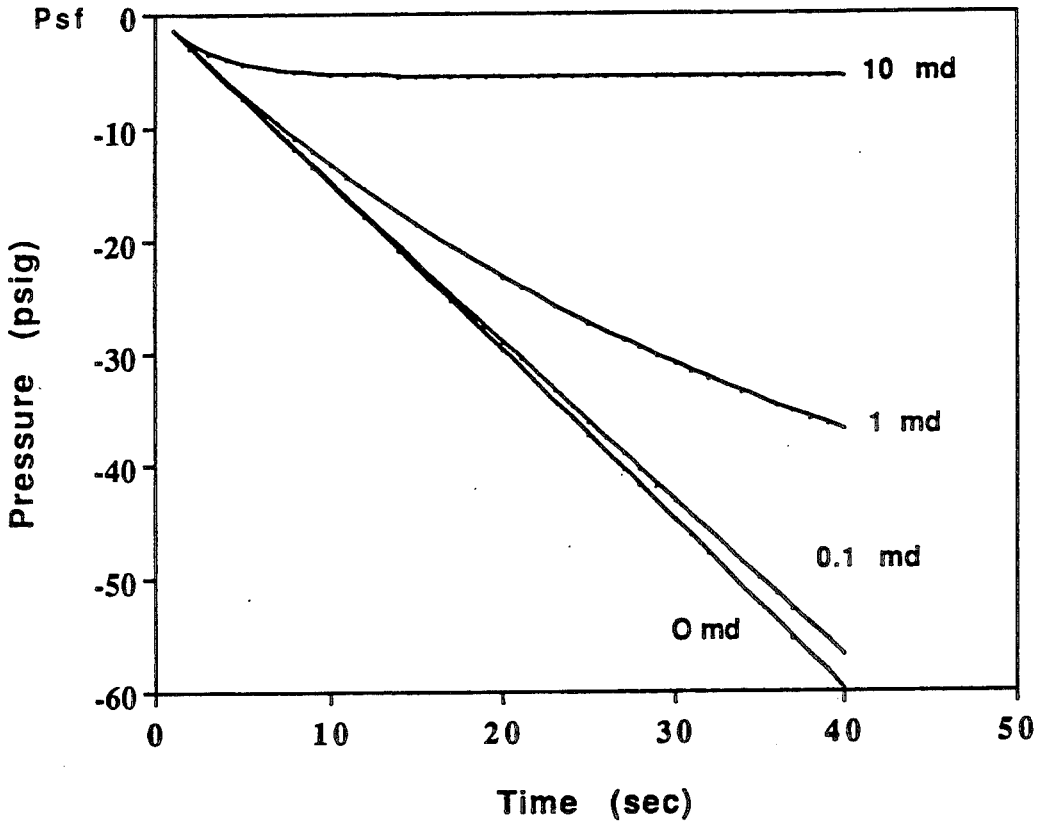
FIG. 7 hereof is a representation of a set of theoretical pressure versus time curves for formations of various degrees of permeability in the range of 0.1 to 10 millidarcies. The curves begin at a time when the sand face pressure is read and continues until the chamber of the test tool will be full. These curves are used to determine the permeability of the formation by matching them to a pressure versus time curve obtained by the practice of the present invention at down hole conditions.

A theoretical set of curves from the sand face pressure onward, each for a different permeability, is generated for curve matching purposes. These curves are used to determine the permeability of the formation for a given bore hole diameter, isolated interval, and flow rate. "Time Difference Calculations" are used to generate the data points for the curve. These types of calculations are well know to those having ordinary skill in the art and thus they will not be discussed herein in detail. For example, a short time interval of 1 second is chosen, and for 10 each time interval, it is assumed that the differential pressure is constant. That is, the difference in pressure between the mud pressure and the formation pressure. The flow rate is then computed for the next time step, and knowing the flow rate then allows for the computation of a new differential pressure. These steps are repeated to produce the appropriate curve. FIG. 7 hereof represents a set of theoretical curves generated for various permeabilities ranging from about 0.1 to 1 md. They correspond to that phase of a test that would start at the time the sand face pressure is measured.

The permeability of the formation can now be determined by matching the pressure versus time curve resulting from the practice of the present invention against the theoretical set of curves. For example, if FIG. 6 were a curve resulting from the practice of the present invention at down hole conditions, the section of the curve between $t_3$ and $t_5$ would be matched against the set of theoretical curves generated for FIG. 7 hereof, to determine permeability.

The formation pressure can be calculated by solving the following equation:

$$P_3 = P_{sf} - (q_m)(\mu)(1n\ rw/re)/(7.08)(k)(h) \quad (2)$$

where, $P_e$ is the formation pressure;

$q_m$ is the flow rate of the liquid mud (filtrate) passing through the mud cake in barrels per day;

$\mu$ is the viscosity of the filtrate in centipoise;

h is the thickness of the formation in feet;

$P_{sf}$ is the sand face pressure in psi;

$r_w$ is the radius of the bore hole in feet;

$r_e$ is the radius of the pressure perturbation in feet;

k is the permeability of the formation in darcies; and 7.08 is the unit conversion factor.

Another characteristic of the formation which can be measured is the invasion diameter. That is, the extent of the distance the liquid phase mud has invaded the formation. The invasion diameter can be determined by solving the equation:

$$D_i = 24[(q_m)(5.6154)/(3.1459\ PHIF) + r_w^2]^{0.5} \quad (3)$$

where, $D^i$ is the invasion diameter in inches;

$q_m$ is the flow rate of the filtrate in barrels/day;

PHIF is the filtrate invaded formation porosity in fraction; and $r_w$ is the diameter of the bore hole in inches;

The filtrate invaded formation porosity is:

$$PHIF = Sxo\ PHI$$

where,

Sxo is the filtrate saturation(1 in water zones, <1 in hydrocarbon bearing zones), and PHI is the formation porosity.

Figure 5:
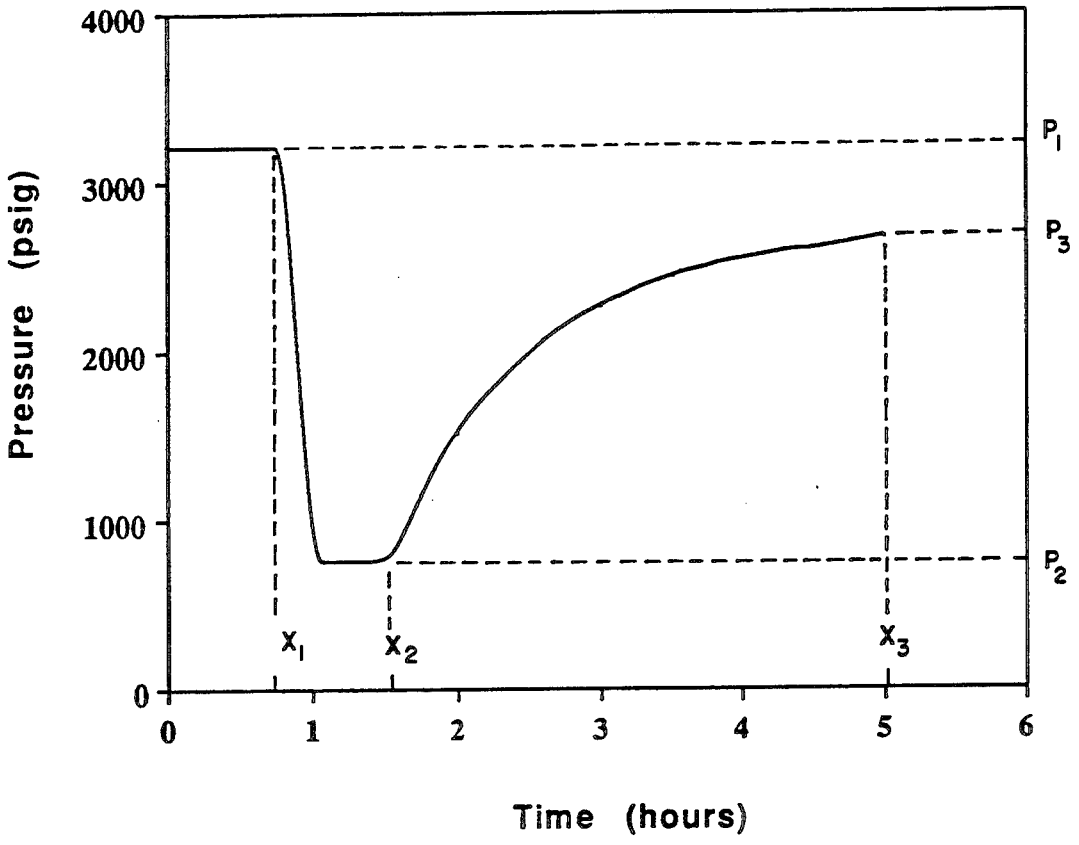
FIG. 5 hereof is a representation of a pressure versus time curve which can be obtained from a formation test, in an open, low permeability formation, using a conventional type of down hole test tool. That is, one which is not designed and operated to control decompression of the mud.

FIG. 5 hereof is a pressure versus time curve which is typically obtained by conventional techniques with a conventional down hole test tool for testing a low permeability formation. In fact, this is substantially the same curve as that shown in U.S. Pat. No. 4,423,625. In this Figure, pressure P represents the hydrostatic pressure of the mud. At time $X_1$, when mud is allowed to enter the chamber of the test tool, it enters at a flow rate wherein substantial instantaneous decompression of the drilling fluid occurs. This results in a pressure drop to pressure $P_2$, which is far below the formation pressure $P_3$. Time $X_2$ represents the time at which fluid no longer enters the tool. Over a substantial period of time, from time $X_2$ to $X_3$, the pressure builds and the formation pressure $P_3$ is reached. Thus, if a formation were tested by such a method, it would not be possible to determine such phenomena as flow rate of liquid phase mud passing through the mud cake, invasion diameter, and supercharging. Furthermore, it is doubtful that the formation pressure and permeability could even be determined in an open well, owing to the extensive amount of time required to perform the test.

Figure 2:
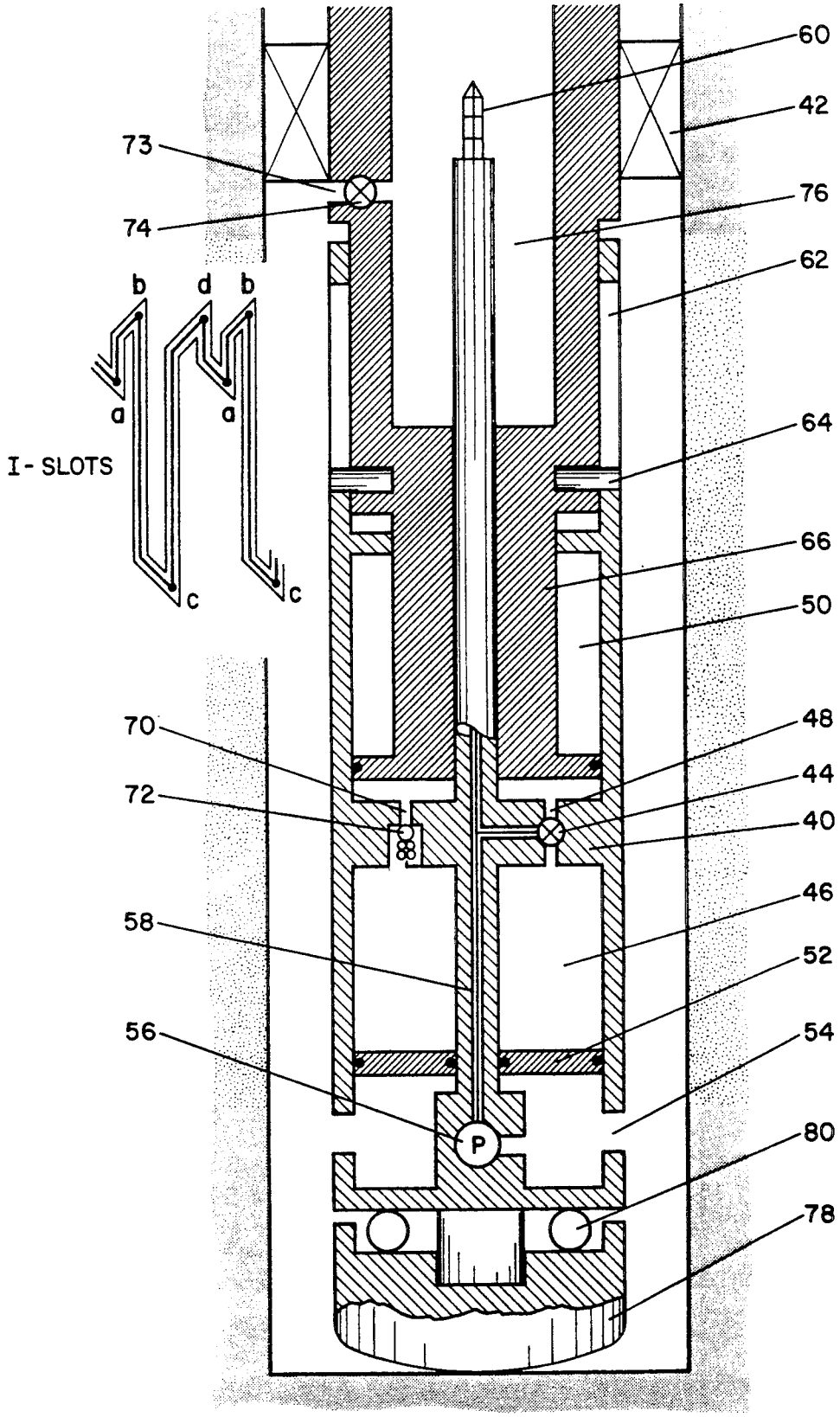
FIG. 2 hereof is a schematic of a alternative down hole test tool of the present invention, but which can be used for making multiple tests before having to be raised to the surface. The tool shows an isolated bore hole interval defined by a single packer and the floor of the bore hole.

FIG. 2 hereof is a schematic representation of another down hole test tool 40 which incorporates the principles of the present invention, but which is designed to perform multiple test before being raised to the surface. This multi-test tool, as with the single-test tool of FIG. 1 hereof, contains a packer 42, a valve 44 for letting the hydraulic fluid of lower chamber 46 pass through choke 48 into upper chamber 50 by the upward action of piston 52 which is activated by mud entering the tool through port 54. This tool also contains a pressure sensing means 56 in electrical communication with wet connector 60 through wire 58. While the components of this tool for effectively controlling the decompression of mud are substantially the same as that for the single-test tool of FIG. 1 hereof, it differs in that it is designed to do multiple tests without having to be raised to the surface. For example, the tool contains so-called J-slots 62 which allow the tool to unseat the packer, expel mud from the previous test, reseat the packer, and take another measurement.

The insert of FIG. 2 hereof shows the operation cycle of the tool using the J-slot. Weight on the tool is relieved between points (a) and (b) to allow movement of stud, or dog, 64 to travel along a certain J-slot track and unseat the packer at 10 point (b). Between points (b) and (c) weight is again put on the tool by contacting it against the bottom of the bore hole. The stud then rides along another track of the J-slot which allows piston 66 to move downward, thereby forcing the hydraulic fluid back into the lower chamber through passageway 70 and check valve 72. This of course expels the mud out of the tool through port 54. Weight is again taken off of the tool, thereby raising upper piston section 66 with the stud riding in the slot to point (d). When weight is then put back on the tool, it is again in test position with the stud resting in the slot at point (a), thus completing the cycle of: unseating the packer, expelling the mud, and reseating the packer. In order to help the tool rotate during this cycle, a swiveling bullnose 78 containing ball bearings 80 can be provided. It will be noted that the tool can also be designed to allow for a sample of fluid to enter passageway 73 through valve 74 and into interval space 76, which sample can then be brought to the surface for analysis.

Figure 3:
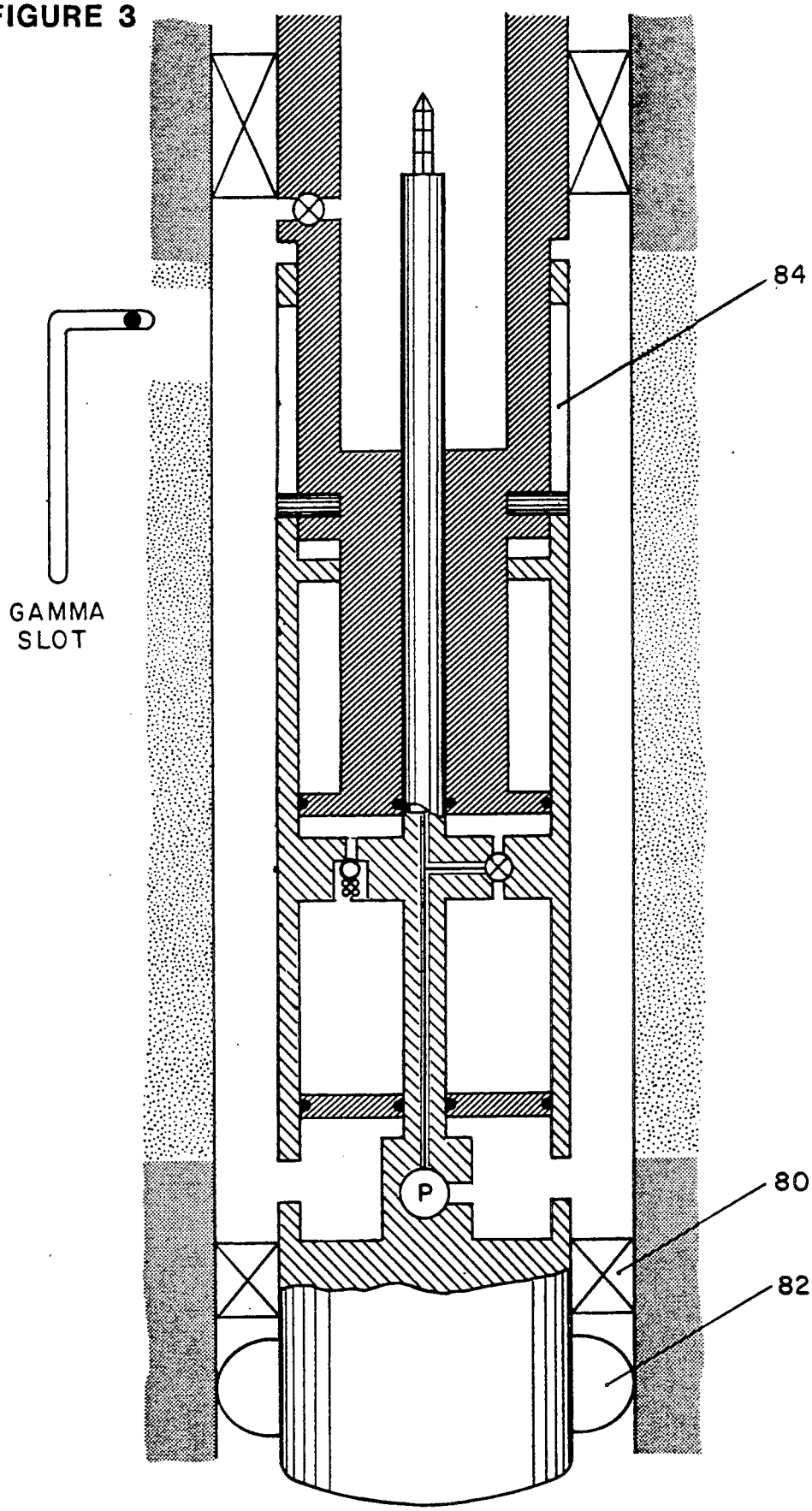
FIG. 3 hereof is a schematic of yet another alternative down hole test tool of the present invention for making multiple tests. It shows a straddle-packer system wherein the isolated bore hole interval lies between the two packers.

FIG. 3 hereof is a schematic representation of another test tool incorporating the principles of the present invention and also designed for multiple testing. This tool is similar to that of FIG. 2 hereof except that it is designed to operate with a straddle-packer system which is used for positioning the tool adjacent to a formation which is not at the bottom of a bore hole. The parts of the tool common to the tool of FIG. 2 hereof will not be explained and it is not deemed necessary to number the parts in the figure. The distinguishing features of this tool, which are numbered, are the straddle-packer system 80, the centralizer mechanism 82 for holding the tool in place in the bore hole, and the use of a gamma slot 84 instead of a J-slot. The gamma slot, which is highlighted in FIG. 3 hereof simply allows the test tool to unseat the packers, expel fluid, and reseat the packers by simply rotating the tool clockwise and counter-clockwise and reciprocating the tool up and down. Both the J-slot and the gamma slot are well know to those skilled in the art.

While the present invention will be most appreciated for testing low permeability formations in open bore holes, that is bore holes which are cased only as far as the beginning of the formation, it can also be applied to testing formations of any permeability and any type of bore hole. For example, the present invention can also be practiced in bore holes cased through the formation and to the bottom of the bore hole. In such cases, perforations will be made in the casing by conventional means to allow formation fluid to enter the casing.

Figure 8:
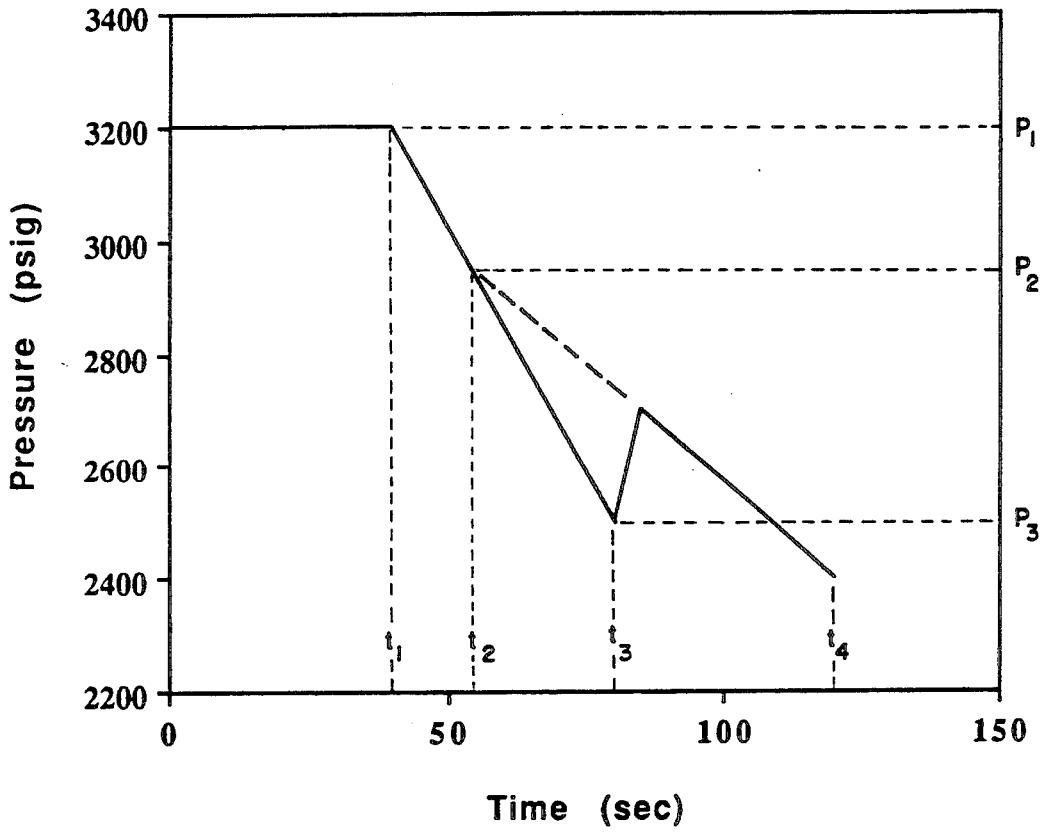
FIG. 8 hereof is a representation of a typical pressure versus time curve which will result from practice of the present invention in a cased low permeability formation.

FIG. 8 hereof is a representation of a pressure versus time curve which will be obtained by the practice of the present invention in a cased bore hole containing perforations for allowing fluid to enter. Any conventional technique can be used for casing the hole and perforating the walls of the casing to receive formation fluid. As can be seen in FIG. 8, phenomena such as mud seepage, and supercharging do not exist. The sharp increase in pressure at $t_3$ is due to the substantial amount of pressure needed to unplug the perforations in the casing before formation fluid can enter the bore hole.

Various changes and/or modifications such as will present themselves to those familiar with the art may be made in the method and apparatus described herein without departing from the spirit of this invention whose scope is commensurate with the following c aims.

What is claimed is:

1. A method for testing subsurface formations from a bore hole containing compressed drilling fluid, which method comprises:

(a) positioning a drill stem down hole test tool down a bore hole adjacent to the formation to be tested, said test tool containing: (i) an entry port, (ii) a chamber of known volume, (iii) a means for controlling the flow rate of the drilling fluid into the test tool, and (iv) a pressure measuring means;

(b) utilizing at least one packer to isolate an 11 interval of bore hole by expanding the packer and sealing the 12 annular space between the test tool and the bore hole;

(c) effectively controlling the flow rate of drilling fluid into the chamber of the test tool so that substantial instantaneous decompression of the drilling fluid does not occur; and (d) measuring and plotting pressure as a function of time from the time the seal is made between the test tool and the wall of the bore hole until at least the time at which the chamber of the test tool is filled with drilling fluid.

2. The method of claim 1 wherein the drilling fluid is mud.

3. The method of claim 2 wherein the flow rate of the fluid entering the test tool is from about 0.4 $in^3$/min to about 40 $in^3$/min for a volume of mud of about 13,000 $in^3$.

4. The method of claim 3 wherein the flow rate is from about 0.8 $in^3$/min to about 8 $in^3$/min.

5. The method of claim 1 wherein the permeability of the formation is less than about 10 millidarcies.

6. The method of claim 5 wherein the permeability of the formation is less than 5 millidarcies.

7. The method of claim 6 wherein the permeability of the formation is from about 0.1 to 1 millidarcies.

8. The method of claim 1 wherein the plot of pressure versus time is analyzed to determine one or more of the following formation characteristics: (a) the flow rate of liquid phase mud passing through the mud cake; (b) the permeability of the formation; (c) the formation pressure; (d) the invasion diameter; and (e) the extent of supercharging.

9. The method of claim 8 wherein the permeability of the formation is determined by comparing the section of pressure versus time plot, starting with the sand face pressure, to a set of theoretical curve generated for various permeabilities.

10. The method of claim 1 wherein multiple tests and plots are made at the same location, or at different locations, in the bore hole, before raising the test tool to the surface.

11. The method of claim 10 wherein the bore hole is cased and the pressure versus time curve is used to determine permeability of the formation and the formation pressure.

12. A method for testing subsurface formations from a bore hole containing compressed mud, wherein said formations have a permeability in the range of about 0.01 to 5 millidarcies, which method comprises:

(a) positioning a drill stem down hole test tool down a bore hole adjacent to the formation to be tested, said test tool which is capable of making multiple tests before being raised to the surface, which tool contains: (i) an entry port, (ii) a chamber of known volume, (iii) a means for controlling the flow rate of the mud into the test tool in the range of about 0.4 $in^3$/min to about 40 $in^3$/min, and (iv) a pressure measuring means;

(b) utilizing at least one packer to isolate an interval of bore hole by expanding the packer and sealing the annular space between the test tool and the bore hole;

(c) effectively controlling the flow rate of mud into the chamber of the test tool so that substantial instantaneous decompression of the drilling fluid does not occur; and (d) measuring and plotting the pressure as a function of time from the time the seal is made between the test tool and the wall of the bore hole until at least the time at which the chamber of the test tool is filled with mud.

13. The method of claim 12 wherein the flow rate of mud into the tool is from about 0.8 $in^3$/min to about 8 $in^3$/min for a volume of mud of about 13,000 $in^3$.

14. The method of claim 12 wherein the plot of pressure versus time is analyzed to determine one or more of the following formation characteristics: (a) the flow rate of liquid phase mud through the mud cake if the bore hole is not cased; (b) the permeability of the formation; (c) the formation pressure; (d) the invasion diameter; (e) the extent of supercharging.

15. The method of claim 12 wherein the permeability of the formation is determined by comparing the section of pressure versus time plot, starting with the sand face pressure, to a set of theoretical curves generated for various permeabilities.

16. The method of claim 12 wherein the plot of pressure versus time is from a cased bore hole and used to determine one or both of the permeability of the formation and the formation

17. A drill stem down hole test tool for testing subsurface formations, which test tool comprises:

(a) an elongated housing;

(b) at least one packer;

(c) at least one entry port for receiving drilling fluid into the test tool;

(d) at least one chamber of known volume;

(e) a means for effectively controlling the flow rate of drilling fluid into the test tool;

(f) a pressure sensing means in communication with a recording means.

18. The test tool of claim 17 which contains an upper chamber and a lower chamber, which lower chamber is filled with hydraulic fluid and said chambers being in communication with one another by way of a choke for controlling the flow rate of hydraulic fluid into the upper chamber, wherein said lower chamber also contains a floating piston for forcing the hydraulic fluid through said choke and into said upper chamber by pressure exerted by the mud.

19. The test tool of claim 18 which also contains means for unseating the packer, expelling the fluid, reseating the packer, and obtaining another set of measurements, without having to be raised to the surface.

20. The test tool of claim 19 which also contains an interval space in the tool for receiving a sample of fluid, through an entry port, from the bore hole.

21. The test tool of claim 17 which contains two packers for isolating an interval of bore hole.

22. The test tool of claim 19 which contains two packers for isolating a interval of bore hole.

23. The test tool of claim 12 wherein the recording means is in the test tool.

24. The test tool of claim 21 wherein the recording means is in the test tool.

* * * * *